US011344133B2

(12) United States Patent
Van Brussel et al.

(10) Patent No.: US 11,344,133 B2
(45) Date of Patent: May 31, 2022

(54) SUPPORTING MODULE FOR AN ADAPTIVE SLEEP SYSTEM, AND ADAPTIVE SLEEP SYSTEM

(71) Applicant: CUSTOMS NV, Heverlee (BE)

(72) Inventors: Karel Jozel Van Brussel, Leuven (BE); Hans Lieve Jos Druyts, Boutersem (BE); Tom De Wilde, Rotselaar (BE)

(73) Assignee: CUSTOM8 NV, Heverlee (BE)

( * ) Notice: Subject to any disclaimer, the term of this patent is extended or adjusted under 35 U.S.C. 154(b) by 64 days.

(21) Appl. No.: 16/467,081

(22) PCT Filed: Dec. 14, 2017

(86) PCT No.: PCT/EP2017/082828
§ 371 (c)(1),
(2) Date: Jun. 6, 2019

(87) PCT Pub. No.: WO2018/109090
PCT Pub. Date: Jun. 21, 2018

(65) Prior Publication Data

US 2019/0313807 A1 Oct. 17, 2019

(30) Foreign Application Priority Data

Dec. 14, 2016 (BE) ..... 2016/5933

(51) Int. Cl.
*A47C 23/06* (2006.01)
*A47C 19/02* (2006.01)
*A47C 27/06* (2006.01)

(52) U.S. Cl.
CPC ..... *A47C 23/067* (2013.01); *A47C 23/068* (2013.01); *A47C 19/025* (2013.01);
(Continued)

(58) Field of Classification Search
CPC ... A47C 23/067; A47C 23/068; A47C 19/025; A47C 27/061; A47C 27/062; A47C 27/065
See application file for complete search history.

(56) References Cited

U.S. PATENT DOCUMENTS 935,933 A * 10/1909 Shoemaker ..... A47C 27/061 5/253
935,938 A * 10/1909 Smith ..... A47C 27/061 5/253

(Continued)

FOREIGN PATENT DOCUMENTS

DE 20 216 001946 U1 6/2016
EP 0680715 A1 11/1995

(Continued)

OTHER PUBLICATIONS

PCT International Search Report and Written Opinion dated Mar. 13, 2018 in connection with PCT International Application No. PCT/EP2017/082828.

(Continued)

*Primary Examiner* — Peter M. Cuomo
*Assistant Examiner* — Morgan J McClure
(74) *Attorney, Agent, or Firm* — Amster, Rothstein & Ebenstein LLP

(57) ABSTRACT

The present invention relates to a supporting module (100) for use in an adaptive sleep system and to a sleep system comprising such supporting modules, the resistance (resilience) of which can be adapted in a simple manner to the anatomy and/or posture of a user. The supporting module (100) for an adaptive sleep system comprises an uppermost supporting element (110), at least two drive shafts (140, 140'), at least two leaf springs (130, 130') positioned parallel to one another, each leaf spring (130, 130') including a first and a second end, each first end being connected to the first (Continued)

supporting element, and each second end being in contact with an adjacent drive shaft (140, 140') via a coupling element (150), wherein the position of the second end of a leaf spring (130, 130') with respect to the adjacent drive shaft (140, 140') determines the deformation resistance of this leaf spring (130, 130'), and wherein the coupling element (150) has been configured to transmit the rotational motion of at least one drive shaft (140, 140') to the leaf spring (130, 130'), in order to modify the position of the second end of the leaf spring (130, 130') with respect to the adjacent drive shaft (140, 140').

15 Claims, 5 Drawing Sheets

(52) U.S. Cl.
CPC ..... *A47C 27/061* (2013.01); *A47C 27/062* (2013.01); *A47C 27/065* (2013.01)

(56) References Cited

U.S. PATENT DOCUMENTS

| | | | | | |
|---|---|---|---|---|---|
| 2,545,310 | A * | 3/1951 | Rosberger | A47C 27/061 | 5/658 |
| 3,739,409 | A * | 6/1973 | Johnson | A47C 27/144 | 5/697 |
| 5,075,912 | A * | 12/1991 | Elmalek | A47C 23/067 | 5/236.1 |
| 6,098,223 | A * | 8/2000 | Larson | A47C 27/088 | 5/716 |
| 8,375,492 | B2 * | 2/2013 | Hsu | A47C 31/123 | 5/697 |
| 8,438,681 | B2 * | 5/2013 | Viberg | A47C 27/064 | 5/716 |
| 8,893,336 | B2 * | 11/2014 | Hsu | A47C 23/0435 | 5/690 |
| 9,578,974 | B2 * | 2/2017 | Kraeutle | A47C 19/027 | |
| 9,955,795 | B2 * | 5/2018 | Krenik | A47C 23/002 | |
| 10,010,188 | B2 * | 7/2018 | Hsu | A47C 27/061 | |
| 10,188,218 | B2 * | 1/2019 | Hyltenfeldt | A47C 27/061 | |
| 10,278,512 | B2 * | 5/2019 | Stjerna | A47C 27/061 | |
| 10,433,654 | B2 * | 10/2019 | Deng | A47C 27/082 | |
| 2012/0137444 | A1 * | 6/2012 | Wong | A47C 21/006 | 5/722 |
| 2016/0166075 | A1 * | 6/2016 | Kraeutle | A47C 23/061 | 5/238 |
| 2017/0156956 | A1 * | 6/2017 | Bai | A47C 27/082 | |
| 2017/0354265 | A1 * | 12/2017 | Kramer | A47C 19/025 | |
| 2018/0042392 | A1 * | 2/2018 | Brown | A47C 20/12 | |
| 2019/0008281 | A1 * | 1/2019 | Chung | A47C 21/06 | |

FOREIGN PATENT DOCUMENTS

| | | | | |
|---|---|---|---|---|
| EP | 2 186 445 | A1 | 5/2010 | |
| EP | 2 191 749 | A1 | 6/2010 | |
| FR | 0680715 | A1 * | 11/1995 | A47C 20/04 |

OTHER PUBLICATIONS

PCT Direct / Informal Comments on the Written Opinion of the European Search Report dated Dec. 14, 2017 in connection with PCT International Application No. PCT/EP2017/082828.

* cited by examiner

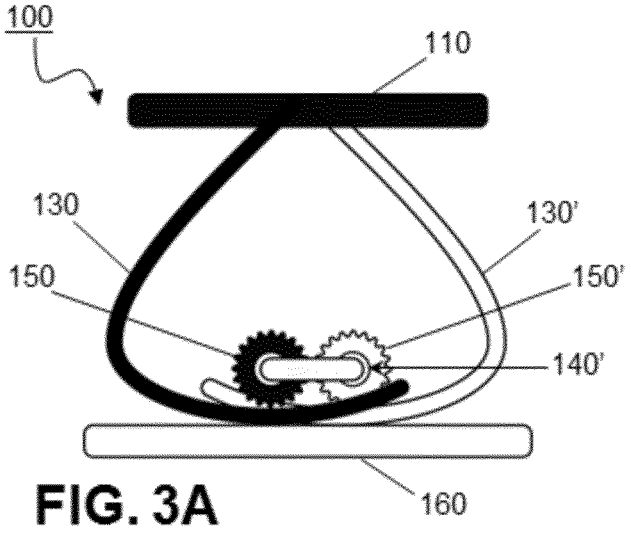
FIG. 3A
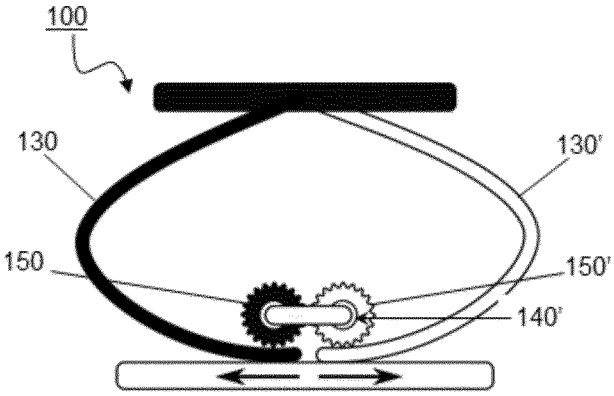
FIG. 3B1
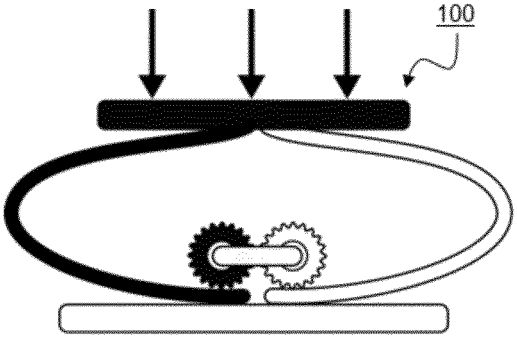
FIG. 3B2
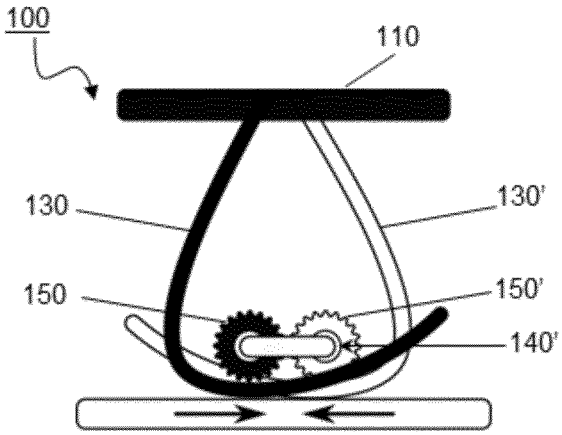
FIG. 3C1
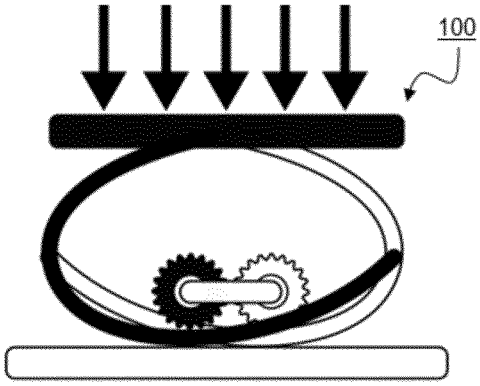
FIG. 3C2

SUPPORTING MODULE FOR AN ADAPTIVE SLEEP SYSTEM, AND ADAPTIVE SLEEP SYSTEM

CROSS-REFERENCE TO RELATED APPLICATIONS

This application is a U.S. national stage entry under 35 U.S.C. § 371 of PCT International Patent Application No. PCT/EP2017/082828, filed Dec. 14, 2017, which claims priority to Belgium Patent Application No. 2016/5933, filed Dec. 14, 2016, the contents of which are incorporated herein by reference in their entirety.

TECHNICAL FIELD

The present application relates to an adaptive sleep system that permits the resilient capacity to be actively and/or passively adapted to the anatomy and/or posture of the user.

TECHNOLOGICAL BACKGROUND OF THE INVENTION

Although good sleep comfort makes an important contribute on to the wellbeing of a person, few sleep systems offer an optimum body support for the user. In a large number of sleep systems, the user rests on a mattress which is supported by a slatted base. In order to offer suitable support to the various zones of the body, various systems allow local adjustment of the resilient capacity or resilience of the slatted base. Accordingly, for example, the zone at the level of the hips can be made less resilient than the zone at the level of the torso.

A number of such systems make use of pairs of slats which can be tightened via a pair of slide arrangements, as described in European patent application EP 0 919 163. Such sleep systems have the drawback that they are adjusted beforehand and do not take into consideration possible changes in the recumbent posture of the user, for example from lying on the side to lying on the back.

Other sleep systems distribute the pressure on the body of the user in a passive manner, under the influence of the weight of the user. An example of such a system is a water bed. Although such sleep systems adapt themselves to the posture of the user, they usually have the detrimental effect that the zone at the level of the hip will sink down too deep, as a result of which a good body support is compromised.

Adaptive sleep systems can constitute a solution to these problems. Such systems are able to modify the body support in an active manner during the sleep of a person, so that the most stringent requirements as regards body support can be met. The range of such systems presently available is limited. European patent EP 2 255 293 describes a sleep system wherein a number of different zones in the system are controlled on the basis of various measurements, which zones are thus able to support the body optimally. This is achieved via separately inflatable chambers. The zones may be controlled in a fully autonomous manner while the users are sleeping.

International patent application WO 2015/139921 describes a sleep system consisting of a plurality of base modules, wherein each base module comprises a set of slats which have been positioned above one another, and wherein the rigidity of the base module and, by extension, the rigidity of the sleep system can be adapted on the basis of a slide mechanism. In this case, two sliding elements are shifted with respect to one another over a length of two or more slats, the shifting corresponding to the change in rigidity.

European patent application EP 0 680 715 describes a sleep system comprising a plurality of transverse bars which are connected at each end to a plurality of bent supports, wherein the lower end of each bent support terminates in a toothed wheel, which engages with each other. When a load is applied on one side of the bed base and thus on one end of the bars connected to an end piece, the supports undergo a deformation which causes a rotational movement of the two supports. This movement is transmitted by a rod to the opposite end of the bed, which can thus be simultaneously reproduced by a connected support. Consequently, this allows for a uniform deformation of the mattress regardless of where the load is applied. However, the resilience of the sleep system of EP 0 680 715 cannot be adapted.

However, the current adaptive sleep systems are very complex, resulting in a greater risk of defects. Consequently, correct operation may be jeopardised. The complexity may also reduce the user-friendliness due to the fact that faulty adjustments are more difficult to detect by an ordinary user. In addition to this, the complex construction also requires a significant amount of (expensive) material and labour, which raises the costs of production and the selling price. As a result, such complex systems are used, above all, for analysis of sleep behaviour and not as a sleep system for everyday use, for example by users with back complaints. There is therefore a need for an adaptive sleep system that offers a solution to one or more of the foregoing problems.

SUMMARY

It is an object of the present invention and the preferred embodiments to offer a solution to one or more of the aforementioned and other drawbacks. For this purpose, the present invention, in its most general form, relates to a supporting module for use in a sleep system, the resistance or resilience of which can be adapted in a simple manner. In addition to this, the sleep systems provided herein, which consist of various supporting modules according to the present invention and in which different supporting modules form different zones, have the advantage that the resilience of various zones can be adjusted in order to offer different levels of support. Besides, the systems described herein can be adjusted as an adaptive sleep system comprising a plurality of supporting modules, the resilient capacity of which can be actively adapted to the anatomy and/or posture of a user.

The inventors have discovered that the supporting module and/or the adaptive sleep system including a supporting module according to the present invention lead(s) to improved user-friendliness, comfort, safety and stability of the sleep system, a greater range of adjustment of the mechanical characteristics, as well as a more efficient production cost and/or production time in comparison with the sleep systems according to the state of the art.

In particular, the invention comprises the following aspects:

In a first aspect the invention provides for a supporting module (100) for an adaptive sleep system, comprising:

- a first, uppermost supporting element (110);
- at least two drive shafts (140, 140'), the drive shafts being situated in a plane, parallel with respect to the first supporting element (110);
- at least two leaf springs (130, 130') positioned parallel to one another, each leaf spring including a first and a second end, each first end being connected to the first supporting element (110), and each leaf spring being in contact with an adjacent drive shaft (140) via a coupling element (150);

wherein the position of the second end of a leaf spring (130) with respect to the adjacent drive shaft (140) determines the deformation resistance of this leaf spring (130), and wherein the coupling element (150) has been configured to transmit the rotational motion of at least one drive shaft (140) to the leaf spring (130), in order to modify the position of the second end of the leaf spring (130) with respect to the adjacent drive shaft (140).

It is understood that, in the supporting module for an adaptive sleep system according to the present invention, the resilience of the leaf spring is adaptable and depends on the position of the leaf spring with respect to the adjacent drive shaft.

In a preferred embodiment the second end of a leaf spring (130) forms a coupling with the coupling element (150) via a plurality of complementary elements.

In a preferred embodiment, the coupling element (150) of a first drive shaft (140) and the coupling element (150') of a second drive shaft (140') form a coupling with one another via a plurality of complementary elements.

In a preferred embodiment, the coupling element(s) (150) and the second end of the leaf spring(s) (130) include teeth, ribs or grooves engaging one another.

In a preferred embodiment, the supporting module (100) further comprises a second, lowermost supporting element (160), the second end of each leaf spring (130) having been clamped between the adjacent drive shaft (140) and the second supporting element (160).

In a preferred embodiment, the leaf springs (130) have been manufactured from an elastic synthetic material or composite material, preferably from a thermoplastic elastomer.

In a preferred embodiment, wherein the supporting module further includes a driving gear (190) configured to drive at least one drive shaft (140).

In a preferred embodiment, the supporting module (100) further includes a control unit configured to control the driving gear and the drive of at least one drive shaft.

In a preferred embodiment, the control unit includes one or more sensors (250).

In a second aspect the invention provides for an adaptive and modular sleep system (200) comprising a plurality of supporting modules (100) as envisaged herein, of which the uppermost supporting elements (110) of the plurality of supporting modules (100) together form a lying surface, i.e. an area suitable for a body to lie on.

In a preferred embodiment, at least some of the plurality of supporting modules (100) have been coupled with one another.

In a preferred embodiment, the adaptive and modular sleep system (200), comprises at least two groups of each one or more supporting modules (100) which have been coupled with one another, each group of supporting modules having a different resilient capacity. Preferably, each group of supporting modules (100) has been provided with a separate driving gear (190) for driving at least one drive shaft of a plurality of supporting modules within the pertinent group of supporting modules (100).

In a preferred embodiment, the adaptive and modular sleep system (200) comprises a plurality of slatted modules (200), wherein in each slatted module at least two of the supporting modules (100) have been coupled to a horizontal slat (210), or wherein the uppermost supporting elements of at least two supporting modules (100) together form a horizontal slat (210), and wherein the horizontal slats of a plurality of slatted modules (200) together form a lying surface.

In a preferred embodiment, the plurality of supporting modules (100) are supported by a covering frame or sleep-system supporting element.

In another aspect, the invention provides for a use of a supporting module (100) according to one or more embodiments as described herein as a component of an adaptive and modular sleep system (200). Preferably, in such use, the resilient capacity is adapted to the posture, weight and/or anatomy of a user of the adaptive and modular sleep system (200).

DESCRIPTION OF THE FIGURES

The following description of the figures of specifically provided embodiments of the systems described herein is given only by way of example, in order to illustrate the features of the invention better, and is not intended to limit the present explanation, its application or use. In the drawings, corresponding reference numbers refer to the same or corresponding parts and features.

Throughout the figures the following numbering is adhered to: 100, 100'—supporting module; 110—uppermost, first supporting element; 130, 130'—leaf spring(s); 140, 140'—drive shaft(s); 150, 150'—coupling element(s); 160 —lowermost, second supporting element; 190, 190'—driving gear(s); 200—adaptive and modular sleep system; 210—horizontal slat; 220—frame; 250—sensor.

FIG. 3 shows a schematic representation of a supporting module (100) according to a preferred embodiment of the present invention, wherein the modification of the deformation resistance is illustrated. FIG. 3A shows a first state with a first position of the leaf springs (130, 130'); FIG. 3B1 shows a second state with a second position of the leaf springs (130, 130'), in which connection FIG. 3B2 illustrates the change in deformation resistance with respect to the first state; FIG. 3C1 shows a third state with a third position of the leaf springs (130, 130'), in which connection FIG. 3C2 illustrates the change in deformation resistance with respect to the first state.

DETAILED DESCRIPTION

Figure 1A:
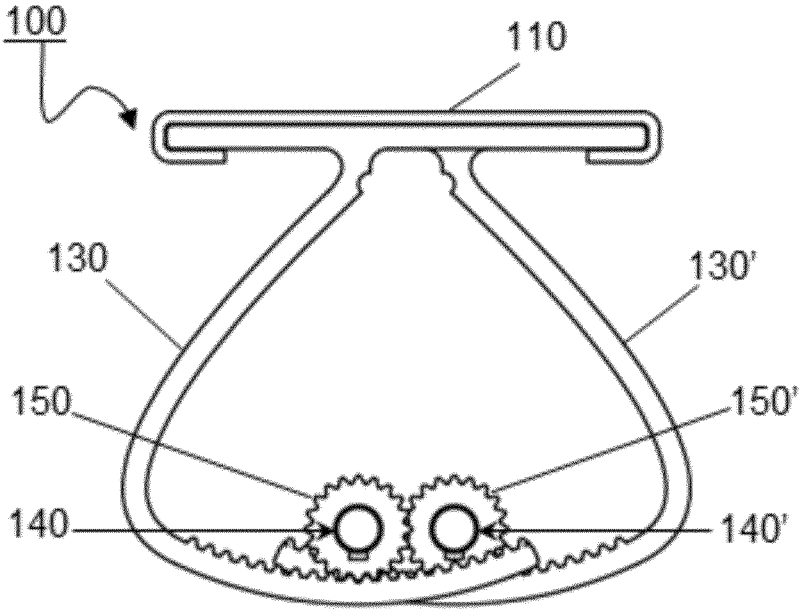
FIG. 1 shows a schematic representation of a supporting module (100) according to a preferred embodiment of the present invention, wherein the supporting module (100) is shown in front view (FIG. 1A), in top view (FIG. 1B), and in bottom view (FIG. 1C).

As used in the text below, the singular forms "a", "an", "the" encompass both the singular and plural form, unless the context is clearly otherwise.

The terms "comprise", "encompass", "comprises", "encompasses" as used below are synonymous with "inclusive", "include" or "contain, "contains" and are inclusive or open and do not exclude additional, unnamed members, elements or procedural steps. The terms "comprise", "encompass", "comprises", "encompasses" are inclusive of the term "contain".

The summary of numerical values on the basis of a numerical range encompasses all values and fractions within these ranges, as well as the cited end-points.

The term "approximately" as used when reference is made to a measurable value such as a parameter, a quantity, a period of time, and so forth, is intended to include variations of +/−10% or less, preferably +/−5% or less, more preferably +/−1% or less, and still more preferably +/−0.1% or less, of and from the specified value, insofar as the variations are applicable in order to function in the disclosed invention. It should be understood that the value to which the term "approximately" refers was also disclosed. All the references cited in this description are hereby incorporated in their entirety by reference.

In the following passages, various aspects of the invention are defined in more detail. Any aspect so defined can be combined with another aspect or aspects, unless the contrary is clearly stated. In particular, a feature indicated as "preferred" or "advantageous" can be combined with other features or properties that are mentioned as "preferred" and/or "advantageous". Reference in this specification to "one (preferred) embodiment" or "a (preferred) embodiment" signifies that a particular function, structure or characteristic described in connection with the embodiment is used in at least one embodiment of the present invention. When the phrases "in one (preferred) embodiment" or "a (preferred) embodiment" are mentioned at various places in this specification, they do not necessarily refer to the same embodiment, although this is not excluded. Furthermore, the described features, structures or characteristics can be combined in any suitable manner, as will be clear to an expert in the subject-matter on the basis of this description. The described (preferred) embodiments in the claims can be used in any combination. In the present description of the invention, reference is made to the accompanying drawings which constitute part thereof and which illustrate specific embodiments of the invention. Figures in brackets or in bold, connected to particular elements, illustrate the pertinent elements as an example, without hereby limiting the elements. It should be understood that other embodiments can be used, and structural or logical modifications can be made, without departing from the scope of the present invention. The following detailed description should not be considered as limiting, and the scope of the present invention is defined by the appended claims.

Unless defined otherwise, all terms disclosed in the invention, inclusive of technical and scientific terms, have the meaning that a person skilled in the art usually comprehends. As a further guiding principle, definitions are incorporated for further elucidation of terms that are used in the description of the invention.

The term "end" of an object, in particular "end of a leaf spring", as used herein also encompasses a part of this object, in particular the leaf spring, that is located close to that end; more specifically, the first and the second end also encompass the part that is located at a distance from the end that is less than 10% of the length or of the relevant dimension of the object, in particular the leaf spring, preferably less than 5% of the length or of the relevant dimension of the object, in particular the leaf spring.

The term "perpendicular" as used herein may encompass a certain deviation from an exactly perpendicular orientation. More particularly, a first surface or object is deemed to be positioned perpendicularly with respect to a second surface or object if the angle between the surfaces determined by these objects amounts to between 85° and 95°, preferably between 87° and 92°, more preferably between 88° and 91°, and most preferably 90°.

The term "parallel" as used herein may encompass a certain deviation from an exactly parallel orientation. More particularly, a first surface or object is deemed to be positioned parallel with respect to a second surface or object if the angle between the surfaces determined by these objects amounts to between 0° and 5°, preferably between 0° and 2°, more preferably between 0° and 1°, and most preferably 0°.

The term "lying surface" as used herein indicates the surface of the sleep system for supporting a mattress or such like and/or for supporting a user of the sleep system.

The term "sleep system" as used herein refers to an arrangement such as a bed which is usually used in order to sleep. However, it will be clear to a person skilled in the art that this term is not intended to express a limitation to the possible use of the systems. Accordingly, the sleep systems described herein can also be used in order to lie thereon, without sleeping necessarily taking place.

The terms "deformation resistance" or "resistance to deformation" of a leaf spring and/or a supporting module refer to the structural property or stiffness of a leaf spring and/or a supporting module to resist a deformation under the influence of a force (pressure) from the outside. A special example of a deformation of a leaf spring and/or supporting module is a flexure, in which connection a "flexural resistance" or "resistance to flexure" may also be mentioned. This property is determined by a combination of a number of structural and material properties, inter alia the strength, elasticity, plasticity, fracture resistance, and so forth. These properties are defining for, and can be regarded as synonymous with, "spring capacity" or "resilient capacity". The terms "deformation angle" or "angle upon deformation" or, in particular, "bending angle" or "angle of flexure" are directly connected to the deformation resistance or flexural resistance of the leaf spring and are determined by the deformation, such as displacement or flexure, of the leaf spring with respect to a reference position of the leaf spring in unloaded form. In the context of the present invention, this reference position may take the form of a non-straight line and/or a deformed condition, depending on the position of the second end of the leaf spring with respect to the adjacent drive shaft, or, stated otherwise, depending on the position of the point of contact between the leaf spring and the adjacent drive shaft along the length of the leaf spring: upon a rotational motion of this drive shaft, the position of the second end will change (or the place of the point of contact between leaf spring and adjacent drive shaft along the leaf spring will change), and as a result of this the reference position will also change. When subsequently a force (pressure) is exerted on the leaf spring, the latter will deform to a particular deformation state which is dependent on the magnitude of the force (pressure) and the deformation resistance. The "maximal deformation" is defined as the maximal deformation that the leaf spring can resist without suffering damage such as plastic deformation, fracture, and such like. In a special example, this deformation can also be measured as a deformation angle or flexural angle. The maximal deformation angle or flexural angle is then the maximal flexure that a leaf spring can undergo without damage.

The applicant has developed a supporting module for use in an adaptive sleep system, in which the resistance and the resilient capacity of the supporting module and consequently of the sleep system comprising such supporting modules can be adapted in a simple manner to the anatomy and/or posture of the user by means of leaf springs with adaptable stiffness. As a result of a plurality of such supporting modules being positioned over an upper surface, an adaptive sleep system is obtained. The stiffness or deformation resistance of each leaf spring directly determines the resilient capacity of the sleep system. By virtue of the fact that these supporting modules are jointly and/or separately adaptable, the resilient capacity of the adaptive sleep system can also be adapted, in its entirety or limited to particular zones.

An adaptive sleep system comprising the supporting modules according to the present invention is user-friendly, safe, stable and comfortable. By virtue of the fact that the supporting modules can be manufactured simply with the aid of synthetic materials, the construction of the supporting module and, by extension, the complete adaptive sleep system according to the present invention also becomes very time-efficient and cost-efficient. In addition to this, the dimensions of the individual supporting modules according to the present invention are very compact, facilitating their storage. The supporting modules according to the present invention are also very stable and robust, by virtue of which they are less susceptible to wear or fracture. All these advantages contribute further to the time-efficiency and cost-efficiency of the invention; for example, by virtue of the fact that the manpower, transport cost, transport time, installation cost, installation time and/or storage costs can be improved. In addition to this, the inventors have also found that the use of the supporting module and/or of the adaptive sleep system according to the present invention is very suitable to enhance the sleep comfort, wellbeing, body support and/or health of a user, both in the case of a temporary use (e.g. in a hospital after a back injury or in an examination centre in the case of back complaints) and in the case of prolonged use (e.g. at home). The adaptive sleep system as described herein, comprising a plurality of supporting modules according to the present invention, is very suitable for users with very stringent comfort requirements or for users with a medical ailment such as back pain, shoulder pain or an aberrant anatomy and sleep profile, and such like.

Figure 1B:
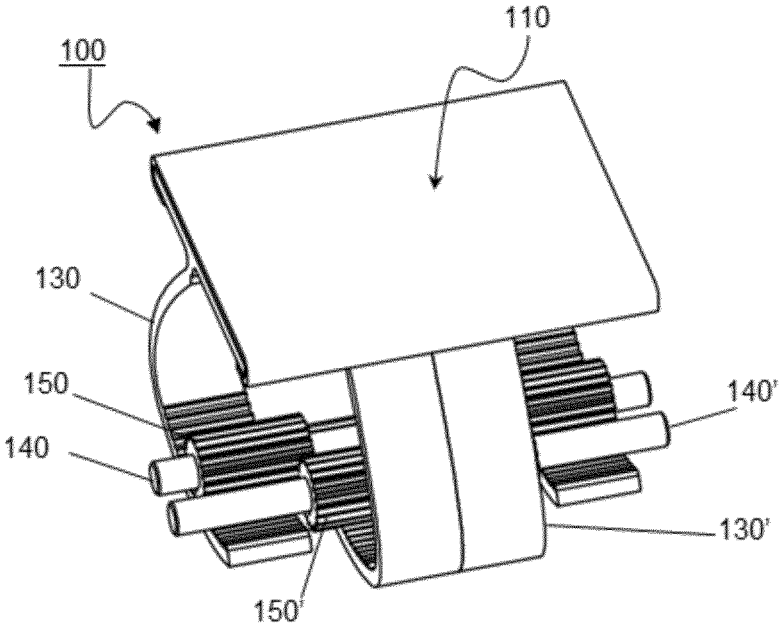
Figure 1C:
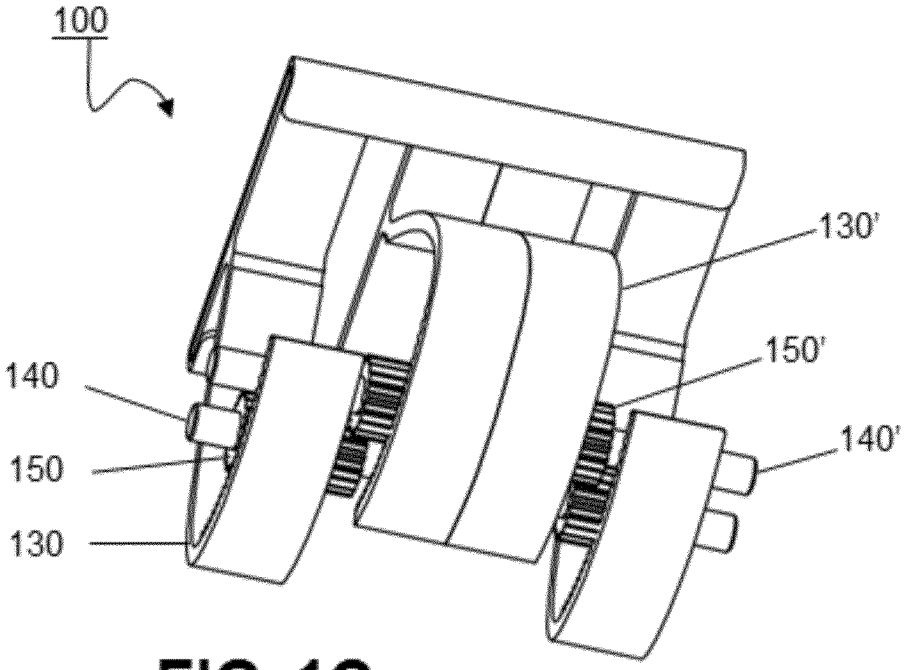

In a first aspect, the invention relates to a supporting module for an adaptive sleep system, comprising: (A) a first, uppermost supporting element, (B) at least one drive shaft, preferably at least two drive shafts, (C) at least one leaf spring, preferably at least two leaf springs which have been positioned parallel to one another, each leaf spring including a first end and a second end, each first end being connected to the first supporting element, and the leaf spring, in particular each second end of the leaf spring, being in contact with an adjacent drive shaft via a coupling element, the position of the second end of a leaf spring with respect to the adjacent drive shaft determining the deformation resistance or stiffness of this leaf spring, and the coupling element having been configured to transmit the rotational motion of at least one drive shaft to the leaf spring, in order in this way to modify the position of the second end of the leaf spring with respect to the adjacent drive shaft. A preferred embodiment of a supporting module according to the present invention is illustrated in FIG. 1 (FIGS. 1A-1C), as discussed below.

In the present invention, the stiffness or deformation resistance of the leaf spring is adaptable, and in this way the resistance and the resilient capacity of the supporting module, and consequently of the sleep system comprising such supporting modules, can be adapted. This is illustrated in FIG. 3. The deformation resistance of the leaf spring is dependent on the position of the second end with respect to the coupling element and/or the drive shaft. The point of contact of the coupling element with the leaf spring determines the point of contact of the leverage. Upon displacement of the second end, in particular by a rotation of the drive shaft, this point of contact shifts over the length of the leaf spring and consequently changes the deformation resistance of the leaf spring. In particular, when the second end is located close to the coupling element and/or the drive shaft—in other words, when the point of contact between the leaf spring and the coupling element is located at or close to the second end of the leaf spring (FIG. 3B1)—the deformation resistance will be minimal and the deformation maximal (FIG. 3B2). The further the position of the second end is removed from the coupling element and/or the drive shaft—in other words, the greater the distance between the second end of the leaf spring and the point of contact between leaf spring and coupling element (FIG. 3C1)—the more the deformation resistance will rise and the deformation (the maximal elastic deformation) will diminish (FIG. 3C2). The position of the second end of a leaf spring can be actively modified by a rotational motion of at least one drive shaft, as a result of which the deformation resistance and the deformation of the leaf spring are consequently also modified. When subsequently a force (pressure) is exerted on the uppermost supporting element, for example by a user, this force will be absorbed by at least two leaf springs which effectively support the uppermost supporting element.

In a preferred embodiment, the point of contact between leaf spring and coupling element can be shifted over at least 10% or 20% of the total length of the leaf spring, preferably over at least 30%, or even at least 35%, in particular whereby the distance between the point of contact between leaf spring and coupling element and an end of the leaf spring is increased or reduced by at least 10% or 20% of the total length of the leaf spring, preferably is increased or reduced by at least 30%, or even at least 35%, with corresponding change of the position of the second end of the leaf spring with respect to the coupling element and/or the drive shaft.

In a preferred embodiment, the leaf springs have been positioned symmetrically and parallel to one another, with the second ends of the leaf spring directed towards an imaginary plane situated between the drive shafts and perpendicular to the uppermost supporting element. This provides for a balanced bending of the supporting element. As a result of this, the supporting module acquires an active adaptation to the total deformation resistance which is the sum of the separate deformation resistances of each leaf spring.

In other preferred embodiments, at least one leaf spring has a deformation resistance different from at least one other leaf spring. The setting of various deformation resistances permits the uppermost supporting element to be caused to rotate at a particular angle, for example from 5° to 25°. This may be necessary for particular therapeutic applications and/or particular anatomical disorders of a user. Besides, some users may experience this as more comfortable.

In some preferred embodiments, the drive shafts are situated in a plane that runs parallel with respect to the uppermost supporting element. By the drive shafts being positioned in the same plane, an additional stability and rigidity of the supporting module is obtained.

Various embodiments may be considered for the coupling element that has been configured to transmit the rotational motion of at least one drive shaft to the leaf spring, in order in this way to modify the position of the second end of the leaf spring with respect to the adjacent drive shaft. In some embodiments, both the coupling element and the leaf spring have been configured to transmit the rotational motion of at least one drive shaft to the leaf spring. In this way, the leaf spring and/or the coupling element may have been configured to aim for a high degree of friction between leaf spring and coupling element, such as, for example, by manufacturing the leaf spring and/or the coupling element from a material with high resistance to friction.

In particular preferred embodiments, the second end of at least one leaf spring and the coupling element have been coupled by a complementary mechanical transmission for an efficient transfer of the rotation of the drive shaft to the leaf spring. In some preferred embodiments, the complementary mechanical transmission comprises a plurality of complementary structures that have been configured to engage one another, such as teeth, ribs, grooves, pins and openings, and the like.

A complementary mechanical transmission generally allows a good transfer of motion of the drive shaft (via the coupling element) and the leaf spring, with, moreover, a minimum chance of obstruction or backsliding. As a result of this, the supporting module becomes even more stable and more reliable. In addition, such complementary mechanical transmission with complementary structures engaging one another permits the rotational motion of a drive shaft to be translated into discrete states, in which connection, for example, each tooth corresponds to a specific state and appertaining deformation resistance of the leaf spring. In other preferred embodiments, the position of the second end of the leaf spring is continuously variable. These various embodiments make it possible that the deformation resistance of the supporting module can be simply adapted to the requirement of the user and/or the producer.

In some embodiments, the coupling element of a first drive shaft and the coupling element of a second, preferably neighbouring, drive shaft have been coupled by a complementary mechanical transmission, preferably comprising a plurality of complementary structures that have been configured to engage one another, such as teeth, ribs, grooves, pins and openings, and the like.

The contact between the coupling elements of two or more drive shafts that permits a mechanical transmission between the drive shafts ensures that a rotation of a first drive shaft leads to a proportional rotation of the second drive shaft, as a result of which the (at least) two coupled shafts rotate by drive of one drive shaft, and consequently the two leaf springs in contact with each drive shaft are displaced at the same time. This provides for a very efficient drive and/or adaptation of the deformation resistance of the supporting module. This is because the deformation resistance of the leaf springs connected to the coupling elements is adapted simultaneously, promoting the reliability, safety and user-friendliness of the supporting module.

In some embodiments, the supporting module further includes a second, lowermost supporting element, configured for supporting the supporting module. As a result of this, the force (pressure) exerted on the supporting module—such as, for example, by a user of the sleep system—is further supported by a second supporting element. In particular embodiments, this may be, for example, a frame or supporting slat of a bed, or an element connected to such a frame or supporting slat. In a preferred embodiment, the drive shafts have been positioned above the lowermost supporting element, optionally with a suspension which prevents the drive shaft from pressing against the supporting element. In a more specific embodiment, the leaf springs have been clamped between the at least one adjacent drive shaft and the lowermost supporting element. As a result of the leaf spring or leaf springs having been clamped, no additional clamping means and/or coupling means are necessary any longer in order to keep the leaf spring stable. Besides, this prevents the leaf spring from springing open or sliding back from the coupling element, for example during setting, and promotes the transfer of the rotational motion from the drive shaft to the leaf spring.

In some embodiments, the uppermost supporting element and the first ends of the at least two leaf springs form a single unit, and/or they have been non-detachably connected. This embodiment provides for an additional stability of the supporting module. Besides, this prevents the uppermost supporting element from becoming detached, for example in the case of a high force such as a heavy weight. As a result of this, the supporting module becomes still safer and prevents undesirable injury in the case of collapse or misuse.

In a most general embodiment, any sort of material is suitable for the leaf springs, so long as it exhibits resilient properties. However, particular resilient sorts of material can undergo a plastic deformation after the passage of time and/or after use, as a result of which they return more slowly, or no longer return, to the condition of rest. By virtue of this, metallic leaf springs in particular are less suitable as a leaf spring in the supporting module according to the present invention.

In particular preferred embodiments, the leaf springs have been manufactured from a resilient synthetic material and/or composite material. In some preferred embodiments, the leaf springs have been manufactured from a thermoplastic elastomer such as the thermoplastic copolyester elastomers (known as TPE, COPE and TPC).

The inventors have found that such elastic synthetic materials and/or composites are very suitable for the invention by virtue of the fact that these materials usually have a good balance between elasticity and rigidity. In particular, thermoplastic elastomers display little to no wear after protracted and/or frequent use, and they can be plastically deformed well. Besides, such materials are freely available, inexpensive and simple in production. In particular, leaf springs are simple to manufacture from thermoplastic elastomers via an injection-moulding process. This contributes further to the time-efficiency and cost-efficiency of the production of the supporting module.

In some embodiments, the leaf springs have a length (in the stretched condition) from at least 5.0 cm to at most 30.0 cm, preferably from 7.5 cm to 25.0 cm, more preferably 10.0 cm to 20.0 cm, most preferably 12.0 cm to 16.0 cm, such as approximately 14.0 cm. In some embodiments, the leaf springs have a width of at least 1 cm, preferably of at least 1.5 cm, such as between 2 cm and 5 cm. In some embodiments, the leaf springs have a width from at least 1.0 cm to at most 20 cm, preferably from 1.5 cm to 10, more preferably between 2 cm and 5 cm.

In some embodiments, the leaf springs are configured to resist a force from at least 1 N to at most 100 N, preferably from 10 N to 80 N, more preferably 25 N to 75 N. In some embodiments, the leaf springs are configured to resist a weight from at least 1 kg to at most 10 kg, preferably from 2 kg to 9 kg, more preferably 3 kg to 8 kg. In some embodiments, the supporting module has been configured to resist a force from at least 1 N to at most 2000 N, preferably from 10 N to 1500 N, more preferably 25 N to 1000 N. In some embodiments, the supporting module has been configured to resist a weight from at least 1 kg to at most 100 kg, preferably from 2 kg to 75 kg, more preferably 3 kg to 50 kg. The term "resist", is understood to mean that the leaf spring and/or the supporting module undergo/undergoes no lasting structural damage such as a plastic deformation, fracture, crack, or such like. A value (e.g. force, weight, angle) that is lower than the stated values is presumed also to be resisted.

Figure 4A:
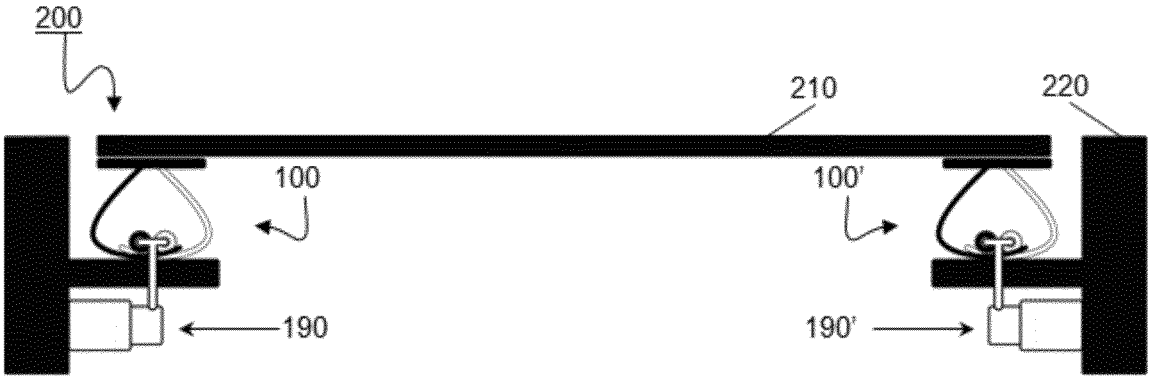
FIG. 4A, FIG. 4B and FIG. 4C show a cross-section of various embodiments of the sleep system comprising a plurality of supporting modules (100, 100') according to a preferred embodiment of the present invention.
Figure 4B:
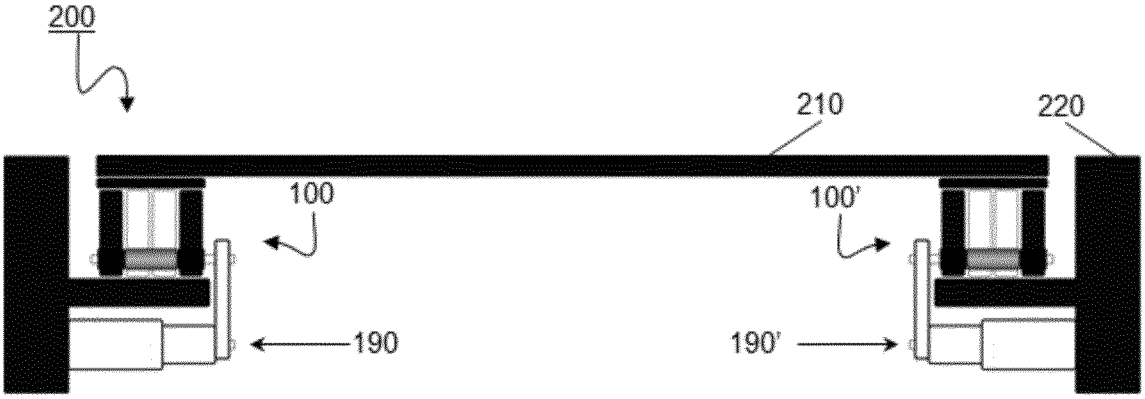

The invention further relates to an adaptive and modular sleep system comprising a plurality of supporting modules according to one of the preceding embodiments, wherein the plurality of uppermost supporting elements form a lying surface. The modular construction of the sleep system permits the sleep system to be adapted in a simple manner to the needs of the user. In some embodiments, the adaptive system comprises a plurality of slatted modules, as represented in FIGS. 4A and 4B, in which case each slatted module comprises at least two supporting modules according to the present invention, in particular in series and coupled to at least one horizontal slat, such as groups of two or three horizontal slats, or in which case the uppermost supporting elements of at least two supporting modules together form a horizontal slat, and in which case the horizontal slats of a plurality of slatted modules together form a lying surface.

In a preferred form, the lying surface of the sleep system is constructed completely from a number of supporting modules as described herein. However, this is not necessary. In particular embodiments, the lying surface of the sleep system may be partially formed by one or more supporting modules as described above, the rest of the lying surface being formed by other elements. Accordingly, for example, it is possible to provide individual supporting modules for the zones of the sleep system that are the most critical for the support of the body, such as the zone at the level of the hips or the shoulders. For other zones, another system may possibly be provided, for example a conventional slatted base.

The precise number of supporting modules from which the sleep system has been constructed may depend on the user, for example on the height of the user. A relatively large number of supporting modules typically permits a greater freedom in the adapting of the sleep system to the user. The separate supporting modules of the sleep system may be identical to one another or may differ from one another.

In some embodiments, the lying surface has been converted into a sleep element, such as into a mattress, as a slatted base and other such like. In some embodiments, the adaptive sleep system is suitable for placing underneath a sleep element; for example, a mattress can be placed on the plurality of supporting modules.

When two or more supporting modules have been combined in a slatted module, the horizontal slats of such a slatted module may have a differing width. In this way, the sleep system can be adapted still better to the anatomy of the user. However, the invention provides that in other embodiments all the slatted modules have an identical width.

The dimensions of the (lying surface of the) adaptive sleep system are typically determined by the length and width of the bed, in particular of the frame of the bed. Besides, this frame may serve as a common lowermost supporting element on which the plurality of supporting modules as described herein rest. Accordingly, for example, one or more boards may be provided, on which the supporting modules are placed. Alternatively, a complete supporting surface may be provided, on which the supporting modules can be placed. The dimensions of the adaptive sleep system are therefore typically of the same order as the typical dimensions of beds and are known to a person skilled in the art.

In particular embodiments, the sleep system includes a frame which surrounds and preferably supports the supporting modules coupled to one another. Such a frame can be used in order to screen the supporting modules physically and visually from the user. The frame can, for example, protect the supporting modules against lateral forces.

In some embodiments, a plurality of supporting modules have been coupled or linked with one another. Such coupling or linking may involve one or more of the following connections:

- the various supporting modules have a common drive shaft;
- the various supporting modules have a common uppermost supporting element; and/or
- the various supporting modules are driven by a common driving gear.

Such coupling of a plurality of supporting modules permits various zones to be demarcated, in which, for example, for the supporting modules in one and the same zone one and the same deformation resistance can be adjusted and/or can be actively adapted.

In some embodiments, the lying surface of the sleep system has been divided up into at least two zones with a differing resilient capacity. In some preferred embodiments, the upper surface for sleeping has been divided up into three zones with a differing resilient capacity: in particular, a first zone adjusted to the shoulders, a second zone adjusted to the waist, and a third zone adjusted to the pelvis area of a user. Such division provides for a particularly comfortable embodiment. In some embodiments, the head zone, chest zone and/or foot zone may also have been configured with a differing stiffness.

In some embodiments, the sleep system comprises a supporting module placed every at least 5 cm to at most 30 cm, preferably 5 cm to 20 cm, more preferably 10 cm to 20 cm, most preferably 10 cm to 15 cm, for example every 12 cm or 13 cm. The space between the supporting modules may be vacant or may be filled up with additional elements such as cabling, driving gear, sensors, protective elements such as a frame, or such like. The inventors have found that the preferred distances provide for an optimal comfort and stability. Higher values may have the result that some zones can be adapted unsatisfactorily; lower values are less to barely perceptible and lead to superfluous use of available means and costs. However, for specific users with, for example, medical problems, divergent distances may be necessary.

In some embodiments, the supporting modules or sleep systems described above may have been provided with a driving gear configured to drive at least one drive shaft of a supporting module according to the invention, in particular to cause a drive shaft to rotate for adjusting the position of the second end of the leaf spring with respect to the adjacent drive shaft and consequently for adjusting the deformation resistance of the leaf spring. Driving gears, drive mechanisms or actuators that can provide such a rotational motion of the drive shaft are known to a person skilled in the art. The driving gear may have been positioned close to a supporting module or may have been positioned far away and may translate the rotational motion to the drive shaft via rods and/or further coupling elements. Additionally or alternatively, each drive shaft or each supporting module can be driven by separate driving gears, for example if different deformation resistances are desirable. In some embodiments, the driving gear comprises a manual drive. This may be, for example, a knob or wheel which the user turns. In preferred embodiments, the driving gear comprises an electric drive. This may be, for example, an electric motor. An electric drive is usually more desirable by virtue of the fact that this gives a faster and more precise drive. In addition, this also prevents difficulty for the user; this is additionally desirable for users with medical complaints. An electric motor does need a current supply, which can be delivered via a battery or a connection as known to a person skilled in the art.

The use of one or more driving gears permits the adjustment of a supporting module or of the separate (groups of) supporting modules of an adaptive sleep system to be automated. In particular embodiments, the control can come about on demand by the user, for example via a remote control or other interface.

In this way, in particular embodiments of the sleep system each supporting module has also been provided with its own driving gear, making it possible to modify the adjustments (in the case of deformation resistance) of the various supporting modules at the same time and independently of one another.

In a preferred form, groups of two or more, such as three or four, horizontal slats are connected to at least two supporting modules.

It is often the case that neighbouring supporting modules are provided with a similar adjustment, for example, according to the shoulders, waist and pelvis of a user. This is possible for the reason that the adjustments of two or more (neighbouring) supporting modules in a group or zone within one sleep system are controlled via one single driving gear, for example via a common drive shaft. In a preferred embodiment, each zone is driven by a different driving gear. As a result of the coupling element of a drive shaft being coupled to the coupling element of a neighbouring drive shaft by the mechanical transmission which can be linked up, a series of connections can be achieved. As a result of this, the deformation resistance of a plurality of supporting modules can be modified by driving only one drive shaft. Additionally or alternatively, these zones can also be driven by one driving gear with several coupling-points.

In some embodiments, the supporting modules or sleep systems described above may have been provided with a control unit configured to control a driving gear. A control unit permits a supporting module or the sleep system to be controlled automatically. This may be, for example, a computer or another device capable of controlling a driving gear.

In some embodiments, the control unit includes a remote control. Additionally or alternatively, the remote control may also be a communication device such as a mobile phone with a program that gives access to the control unit or performs the function of a control unit. Wireless connections for such a control unit are known to a person skilled in the art, for example a Bluetooth receiver.

In some embodiments, the control unit includes one or more sensors, for example accelerometers, position sensors and/or pressure sensors. Such sensors can be placed on the first supporting element and/or a leaf spring. In particular embodiments, the sensors can be provided as a sensor mat which can be placed on the lying surface and/or the mattress. An example of a suitable sensor mat is the Idoshape system developed by Custom8 (Belgium); this sensor mat measures displacements or, more concretely, the deformation of an upper surface when it serves as upper surface of the mattress or is placed between two layers of a mattress. Another example of a suitable sensor mat is a pressure mat wherein a pressure sensor measures the pressure or weight that is exerted on an uppermost supporting element, permitting the deformation resistance of the supporting module to be adapted to the measured pressure.

Figure 4C:
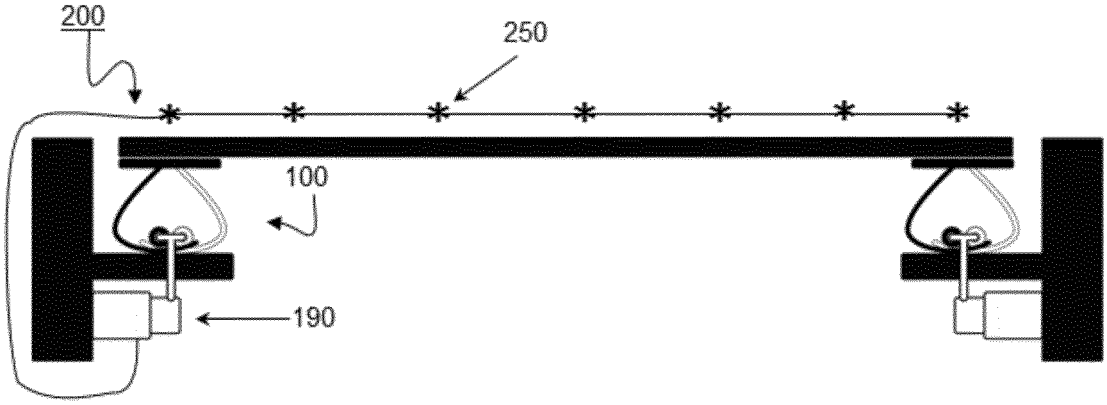

In some embodiments, at least one supporting module, preferably a plurality of supporting modules, may further include a sensor. An example of a sleep system equipped with a sensor on the lying surface is illustrated in FIG. 4C.

However, it is also possible to control the driving gear(s) on the basis of the output of the sensors. In these embodiments, a manual adjustment is preferably replaced by an automatic adjustment. In some embodiments, the control unit has been configured to control the drive in a manner depending on the sensor measurement. This principle can, for example, be applied in order to adapt the deformation resistance of one or more supporting modules or one or more zones of supporting modules to the body profile of the user, such as the height and/or the weight, or alternatively to the sleep profile, such as the position and/or the posture, in order subsequently to offer ideal support.

In some embodiments, the control unit has been configured to control the drive in a manner depending on the user adjustment, for example via a remote control. This principle can, for example, be applied for particular complaints and/or disorders. For example, if a user states that he/she is experiencing shoulder pain, the deformation resistance of one or more supporting modules positioned at the level of the shoulder in the sleep system can be adapted automatically by the control unit, further enhancing the comfort and the user experience.

Sensor-based automatic regulation ensures that the adjustment of one or more supporting modules can also be modified during the sleep of the user, for example in the event of modification of the posture of the user. In this way, the supporting module or the sleep system can provide for an optimal support of the body in practically any sleep posture.

The invention further relates to the use of a supporting module according to one of the preceding embodiments as a component of an adaptive sleep system.

In some preferred embodiments, the resilient capacity of the supporting module is adapted to the position, weight and/or anatomy of a user.

In a further aspect, the invention relates to a use of an adaptive sleep system sleep module according to one of the preceding embodiments, comprising a plurality of supporting modules. In some preferred embodiments, the resilient capacity of the adaptive sleep system is adapted to the position, weight and/or anatomy of a user.

EXAMPLES

In order to further elucidate the properties, advantages and special features of this invention, individual preferred embodiments are set forth in greater detail below with reference to the appended figures. It is clear that such an exposition should not be interpreted as a limitation for the scope of the invention as such and in particular as expressed in the following claims.

Example 1

Arrangement and Action of a Supporting Module (100)

FIG. 1 illustrates a supporting module (100) according to a particular embodiment of the invention, in side view (FIG. 1A), in top view (FIG. 1B), and in bottom view (FIG. 1C).

According to this example, the supporting module (100) comprises an uppermost supporting element (110), at least two drive shafts (140,140'), at least two leaf springs (130, 130') positioned parallel to one another, each leaf spring (130,130') including a first and a second end, each first end being connected to the uppermost supporting element (110), and each second end being in contact with at least one drive shaft (140,140') via a coupling element (150,150') coupled by a mechanical transmission which can be linked up. The mechanical transmission which can be linked up further includes a plurality of complementary structures, in particular gear wheels.

The deformation resistance of the supporting module (100) is determined by virtue of the fact that the position of the second end of a leaf spring (130,130') with respect to the coupling element (150,150'), in particular the position of the point of contact between the coupling element (150,150') and the leaf spring (130,130') with respect to the second end of the leaf spring (130,130'), determines the deformation resistance of the appertaining leaf spring (130,130'). The deformation resistance of the leaf springs (130,130'), and consequently of the supporting module (100), can be adapted by means of the coupling element which in the case of a rotational motion of at least one drive shaft (140,140') has been configured to transmit this motion to the leaf spring, in order in this way to modify the position of the leaf spring, in particular the position of the point of contact between coupling element and leaf spring with respect to the second end thereof.

Figure 2A:
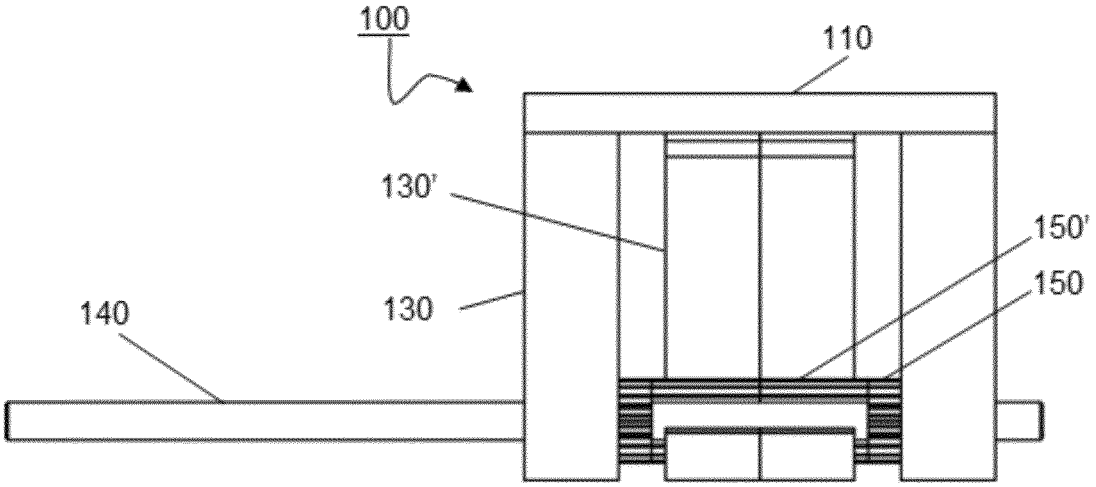
FIG. 2 shows a schematic representation of a supporting module (100) according to a further preferred embodiment of the present invention, wherein the supporting module (100) is shown in side view (FIG. 2A) and in top view (FIG. 2B).
Figure 2B:
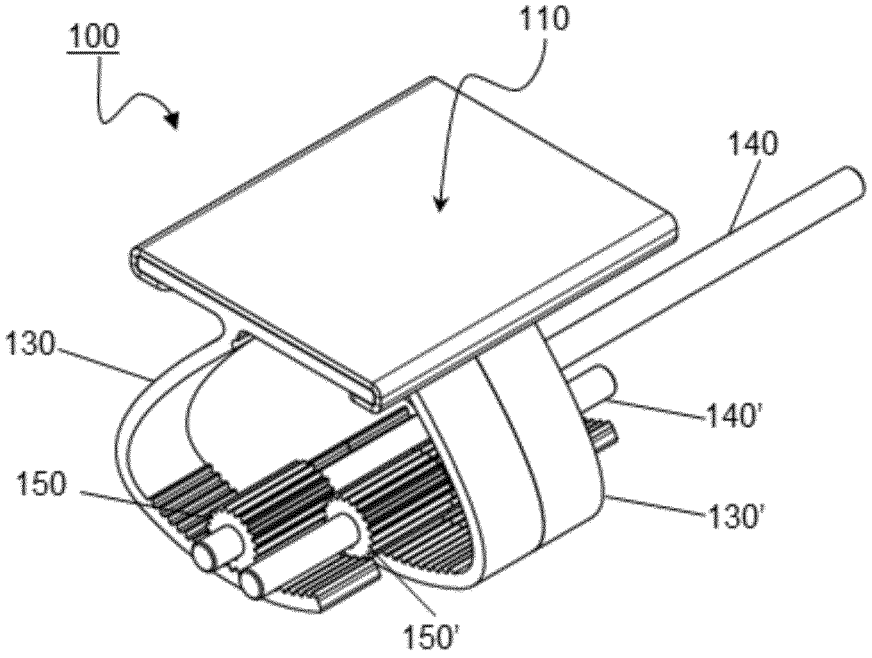

A particular preferred embodiment of a supporting module (100) with a lengthened drive shaft (140) is illustrated in FIG. 2, wherein the supporting module (100) is shown in side view (FIG. 2A) and in top view (FIG. 2B).

As a result of one drive shaft (140) being lengthened, the supporting module (100) can be coupled to a driving gear (not shown in FIG. 2), for example an electric motor, which exerts a rotational motion on the lengthened drive shaft (140). This rotational motion is subsequently transmitted to the second drive shaft via the first coupling element (150) which was coupled to a second coupling element (150'). By virtue of the fact that the two coupling elements (150,150') are connected via a gear coupling, the rotational motion will be translated in a second, opposing direction, for example clockwise to anticlockwise. This ensures that both drive shafts (140,140') modify the position of the second end of the respective leaf springs (130,130') in the desired direction.

This motion of the second end of the leaf springs (130, 130') is illustrated in FIG. 3. The deformation resistance of the leaf spring is dependent on the position of the second end with respect to the coupling element and/or the drive shaft. In particular, FIG. 3A shows a first reference state wherein the second end of the leaf spring (130,130') is located at the bottom of the coupling element and/or the drive shaft, at a particular distance from the point of contact between drive shaft or coupling element and leaf spring. The supporting module according to this embodiment further also includes a lowermost supporting element (160) which supports the supporting module (100), the lowermost supporting element (160) and the drive shafts (140,140') having been positioned in such a way that the leaf spring is clamped between drive shaft (140,140') and lowermost supporting element (160).

FIG. 3B1 illustrates a second state of the supporting module, wherein the position of the second end of the leaf spring (130,130') was modified with respect to the first, reference, state by rotation of the drive shafts (140,140'), so that the point of contact between drive shaft or coupling element and leaf spring has been positioned closer to the second end of the leaf spring—in other words, wherein the distance between point of contact between drive shaft or coupling element and leaf spring and the second end of the leaf spring has been reduced. In this second state of the supporting module the deformation resistance will be minimal and the deformation maximal, as illustrated in FIG. 3B2. The downward arrows indicate the force exerted on a supporting module, in particular the pressure.

FIG. 3C1 illustrates a third state of the supporting module, wherein the position of the second end of the leaf spring (130,130') was modified with respect to the first, reference, state by rotation of the drive shafts (140,140'), so that the point of contact between drive shaft or coupling element and leaf spring has been positioned further from the second end of the leaf spring—in other words, wherein the distance between point of contact between drive shaft or coupling element and leaf spring and the second end of the leaf spring has been increased. In this third state of the supporting module the deformation resistance will be maximal and the deformation minimal, as illustrated in FIG. 3C2. Consequently the exerted force that is required in order to arrive at the same deformation as in FIG. 3B2 (i.e. the second state) will be much greater in FIG. 3C2 (i.e. the third state).

Example 2

Adaptive and Modular Sleep System (200)

FIG. 4 illustrate a preferred embodiment of a component of a sleep system (slatted module, 200). Two supporting modules (100, 100') support a horizontal slat (210). The lowermost supporting element of each module is connected to a frame (220) of the sleep system. A driving gear (190, 190') is connected to a drive shaft of a supporting module (100), in order to rotate the drive shaft. FIG. 4A and FIG. 4B show different embodiments of a component of a sleep system, wherein the drive shafts of the supporting modules (100, 100') have been positioned along the length of the horizontal slat (210) (FIG. 4A) or have been positioned perpendicular to the length of the horizontal slat (210) (FIG. 4B).

A modular sleep system (200) may further also include a sensor (250) such as a pressure sensor or a distance sensor, which permits the deformation resistance of the supporting module to be adapted to the load. FIG. 4C shows a special embodiment wherein the sensor (250) was subsequently coupled to a driving gear (190); this permits the supporting module to be adapted automatically in a manner depending on the sensor measurement. The (*) indicate measuring-points.

The invention claimed is:

1. Supporting module (100) for an adaptive sleep system, comprising:

a first, uppermost supporting element (110);

at least two drive shafts (140, 140'), the drive shafts being situated in a plane, parallel with respect to the first supporting element (110);

at least two leaf springs (130, 130') configured to have an adaptable deformation resistance, each leaf spring having a length defined by the distance measured along the leaf spring between a first and a second end, wherein each leaf spring is in contact with a drive shaft (140) via a coupling element (150) at a contact point positioned along the length of the leaf spring (130);

wherein the first ends of the leaf springs are connected to the first supporting element (110) and extend symmetrically in planes parallel to one another;

wherein the second ends of the leaf springs are directed towards the drive shafts (140, 140') and converge at their respective contact points so that said leaf springs at least partially overlap in a plane parallel with respect to the first supporting element (110) such that a line drawn through said plane would intersect a portion of the second ends of the leaf springs;

wherein the distance between the contact point and the first end can be shifted over at least 10% along the length of the leaf spring (130) around its contact point by rotation of at least one drive shaft (140);

wherein the distance between the contact point and the first end along the length of the leaf spring (130) determines the deformation resistance of this leaf spring (130), wherein the deformation resistance of the leaf springs (130, 130') determines the resilient capacity of the supporting module (100), and wherein the coupling element (150) has been configured to transmit the rotational motion of at least one drive shaft (140) to the leaf spring (130), in order to change the distance between the contact point and the first end along the length of the leaf spring (130), and thereby change the deformation resistance of the leaf spring (130, 130').

2. The supporting module (100) according to claim 1, wherein the second end of a leaf spring (130) forms a coupling with the coupling element (150) via a plurality of complementary elements.

3. The supporting module (100) according to claim 2, in which the coupling element(s) (150) and the second end of the leaf spring(s) (130) include teeth, ribs or grooves engaging one another.

4. The supporting module (100) according to claim 1, wherein the coupling element (150) of a first drive shaft (140) and the coupling element (150') of a second drive shaft (140') form a coupling with one another via a plurality of complementary elements.

5. The supporting module (100) according to claim 1, wherein the supporting module (100) further includes a second, lowermost supporting element (160), the second end of each leaf spring (130) having been clamped between the adjacent drive shaft (140) and the second supporting element (160).

6. The supporting module (100) according to claim 1, wherein the leaf springs (130) have been manufactured from an elastic synthetic material or composite material, preferably from a thermoplastic elastomer.

7. The supporting module (100) according to claim 1, wherein the supporting module further includes a driving gear (190) configured to drive at least one drive shaft (140).

8. The supporting module (100) according to claim 1, wherein the supporting module (100) further includes a control unit configured to control the driving gear and the drive of at least one drive shaft.

9. The supporting module according to claim 8, wherein the control unit includes one or more sensors (250).

10. Adaptive and modular sleep system (200) comprising a plurality of supporting modules (100) according to claim 1, of which the uppermost supporting elements (110) of the plurality of supporting modules (100) together form a lying surface.

11. The adaptive and modular sleep system (200) according to claim 10, wherein at least some of the plurality of supporting modules (100) have been coupled with one another.

12. The adaptive and modular sleep system (200) according to claim 11, comprising at least two groups of each one or more supporting modules (100) which have been coupled with one another, each group of supporting modules having a different resilient capacity.

13. The adaptive and modular sleep system (200) according to claim 12, wherein each group of supporting modules (100) has been provided with a separate driving gear (190) for driving at least one drive shaft of a plurality of supporting modules within the pertinent group of supporting modules (100).

14. The adaptive and modular sleep system (200) according to claim 10, comprising a plurality of slatted modules (200), wherein in each slatted module at least two of the supporting modules (100) have been coupled to a horizontal slat (210), or wherein the uppermost supporting elements of at least two supporting modules (100) together form a horizontal slat (210), and wherein the horizontal slats of a plurality of slatted modules (200) together form a lying surface.

15. The adaptive and modular sleep system (200) according to claim 10, wherein the plurality of supporting modules (100) are supported by a covering frame or sleep-system supporting element.

* * * * *